United States Patent [19]

Burke

[11] 4,124,178

[45] Nov. 7, 1978

[54] ENERGY AND FUEL CONSERVING UNIT HEATER

[76] Inventor: Ralph B. Burke, 5400 Gerland Ave., Baltimore, Md. 21206

[21] Appl. No.: 760,396

[22] Filed: Jan. 18, 1977

Related U.S. Application Data

[63] Continuation-in-part of Ser. No. 629,627, Nov. 5, 1975, abandoned.

[51] Int. Cl.[2] ..... F24H 6/00

[52] U.S. Cl. ..... 237/19; 126/101

[58] Field of Search ..... 165/DIG. 2; 126/101; 237/19

[56] References Cited

U.S. PATENT DOCUMENTS

| | | | |
|---|---|---|---|
| 1,779,714 | 10/1930 | Schmidt | 126/101 X |
| 2,130,894 | 9/1938 | Muir | 126/101 |
| 2,294,579 | 9/1942 | Sherman | 126/101 |
| 2,507,011 | 5/1950 | Hebert | 126/101 X |
| 3,198,190 | 8/1965 | Gordon | 126/101 |
| 3,813,039 | 5/1974 | Wells | 165/38 X |
| 3,999,709 | 12/1976 | Estabrook | 165/DIG. 2 |
| 4,040,477 | 8/1977 | Garberick | 165/DIG. 2 |

*Primary Examiner*—William E. Wayner
*Assistant Examiner*—William E. Tapolcai, Jr.
*Attorney, Agent, or Firm*—J. Wesley Everett

[57] ABSTRACT

The building heating system is by circulating hot air through the building by making use of a hot air furnace for heating the air for normal heat requirements and an auxiliary heater for lesser heat requirement by means of a hot water radiator placed in the air stream leading from the furnace to the air outlet in the building and supplied by a hot water boiler.

2 Claims, 3 Drawing Figures

ENERGY AND FUEL CONSERVING UNIT HEATER

This is a Continuation-In-Part of my earlier application, Ser. No. 629,627, filed Nov. 5, 1975, now abandoned.

The present invention relates to a hot air heating system for buildings including a primary air heating furnace and an auxiliary air heater in the form of a water heated radiator.

The primary object of the invention is to provide a hot air heating system in which air is heated by a hot air heating furnace for normal operations and an auxiliary air heating unit in the form of a water heated radiator supplied with hot water from a water heating boiler for periods requiring less heat to be supplied to the circulating air.

Another object of the invention is to provide a system that will be more economical to operate.

A further object of the invention is to provide a heating system which will have a quicker response to increasing the temperature of the circulated air than is being used at the present time.

A further object of the invention is to provide a hot air heating system with an auxiliary heating unit for use in milder periods of weather.

While several objects of the invention have been pointed out, other objects, uses and advantages will become more apparent as the nature of the invention is more fully disclosed in the following specification in conjunction with the accompanying drawings.

In referring to the drawings, like and similar reference characters are used to point out like and similar parts throughout the several views.

Figure 1:
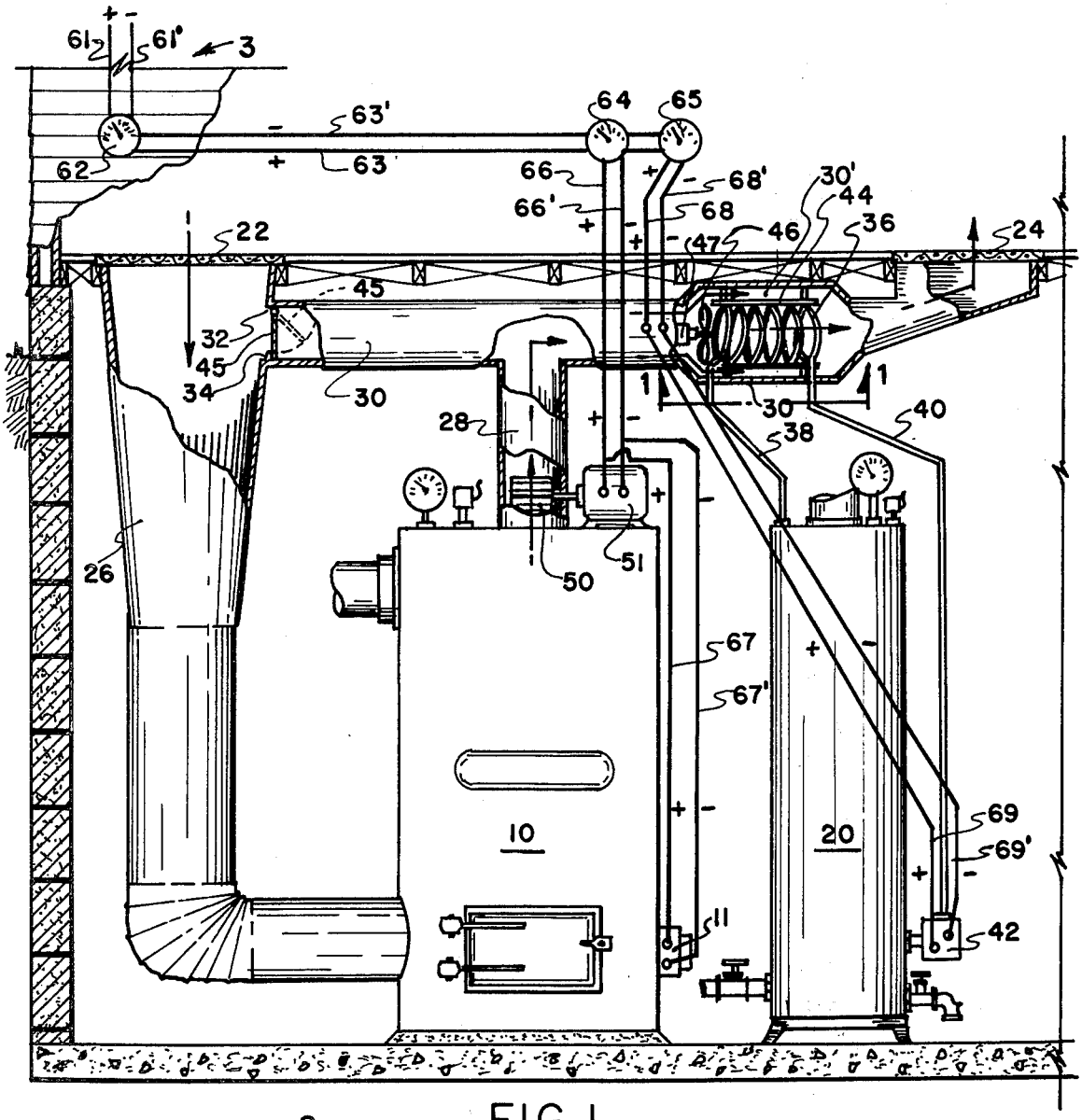
FIG. 1 is an elevational schematic view of the heating system.
Figure 2:
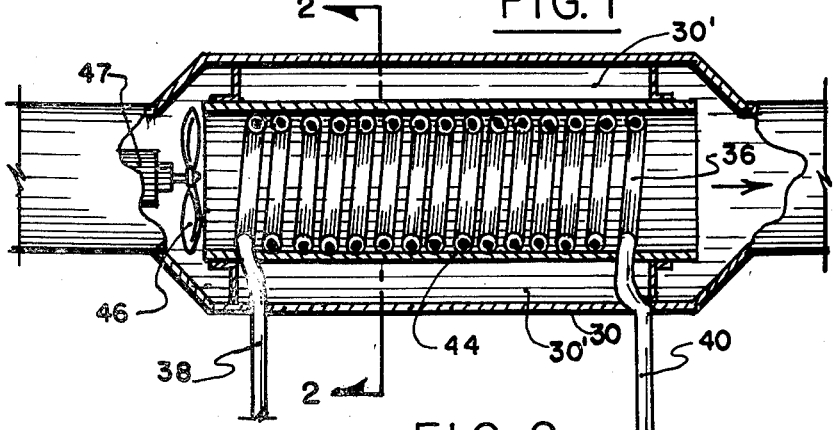
FIG. 2 is a sectional view taken on line 1—1 of FIG. 1.
Figure 3:
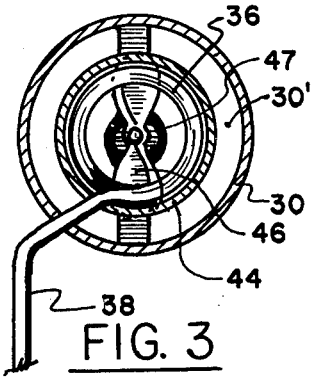
FIG. 3 is a sectional view taken on line 2—2 of FIG. 2.

The heating system comprises a furnace 10, generally referred to as a hot air furnace, and a smaller auxiliary water heating boiler 20. The building 3 is provided with one or more air intake registers, such as shown at 22, and one or more outlet registers such as shown at 24.

Leading from the air intake register 22 is an air duct 26 which extends to the bottom of the hot air furnace 10. The air is heated in the furnace 10 by any suitable means such as shown at 11. The air passes out through the upper pipe 28 to a second duct 30. The duct 30 is connected to the first-mentioned duct 26 at 32 and extends to the outlet register 24.

The hot water heating boiler 20 may be placed at any convenient place. Associated with the second-mentioned air duct 30 and located between the furnace and the air outlet 24 is a hot water radiator 36 having a pipe 38 leading to the hot water boiler 20 for supplying hot water to the radiator and a water return pipe 40 for returning the water to the boiler. A water circulating pump 42 is provided for aiding in the circulation of the hot water through the radiator.

The radiator 36 is encircled by an open ended housing 44. There is provided a fan 46 at one of the open ends of the housing for forcing at least a part of the air within the duct 30 through the housing 44 and about the radiator 36. The fan 46 is only of such size and is so positioned as to circulate the air through the housing.

The second-mentioned duct 30 is provided with a one-way air valve 45 at the jointure 32 of the ducts 26 and 30 for allowing air from the duct 26 to pass into the duct 30 when only the auxiliary heating unit is in operation.

When the furnace is operating, the fan 50, operated by the motor 51, will build up pressure in the duct 30, closing the valve 45 against the stop 34.

Means are provided wherein at least part of the air moving through the duct 30 may by-pass the radiator assembly, such as the housing 44, the fan 46 and the fan motor 47 by enlarging the area 30' of the duct 30 to allow air heated by the furnace to have a free passage around the radiator assembly to the air outlet 24 when the auxiliary heating unit is not operating.

It may be necessary or advisable to operate both heating units at the same time, that is, the furnace and the boiler; however, the system is intended to be operated wherein the furnace is operated in normally cold weather and when there are mild days or periods during the day when the heat requirement is light, the auxiliary unit may be brought into play, that is, the heat requirement is reduced on the furnace and the radiator will supply the requirement for that period.

There may be lengthy periods when it would only be necessary to operate the auxiliary water heater which would make for economical operating in heating the building.

The operation of the furnace and the circulation of the hot water through the radiator 36 is controlled by a suitable outside thermostat 62 which anticipates the need for heat when the outside temperature is lower than the temperature shown on the inside thermostat of the building and two inside thermostats 64 and 65. The inside thermostat 64 in conjunction with the outside thermostat 62 will control the fan motor 51 and the fuel burner motor 11 to operate the furnace which is electrically connected to the thermostat by the wires 66, 66', 67 and 67'.

The hot water heater 20 is controlled by the thermostat 65 and also in combination with the outside thermostat 62 which are electrically connected to the motor 47 operating the fan 46 by wires 68 and 68' and the water circulating pump 42 by the wires 69 and 69'.

While the heating units are normally controlled by the inside thermostats 64 and 65, the outside thermostat 62 is provided to anticipate the outside temperature and start one or more of the heating units in the furnace and/or water heater in advance of the inside thermostats 64 and 65. These outside and inside thermostat units have been in general use for a long time and are of the type that are adjustable as indicated in the drawings and may be set for any temperature and for any period of time.

There is shown a single furnace and a single boiler; however, one or more furnaces and boilers may be employed.

While the invention is shown and described in a specific form, it is not intended as a limitation and the form of the invention is only to be limited by the prior Art.

What is claimed as new is set forth in the appended claims.

I claim:

1. A heating system for a closed building having at least one floor and a space beneath said floor for housing a primary hot air heating unit in the form of a furnace, an air conduit leading from the floor to the bottom of said furnace and means for moving the air through said furnace to an outlet within the floor spaced a substantial distance from the air inlet after the air has reached a predetermined degree by passing through said furnace, the improvement comprising:

a. a second air duct extending substantially in a horizontal plane and adjacent the under side of the floor having one end connected to the first mentioned air duct leading to the bottom of the furnace and the opposite end leading to a remote air outlet positioned in said building, b. a one-way air valve positioned at the jointure of the two air ducts allowing the air to pass only into the horizontal air duct and means for connecting the furnace air outlet leading from the top of the furnace to the said horizontal air duct, c. a hot water heater positioned below the horizontal air duct, d. a radiator positioned within said horizontal air duct and means for circulating hot water through the said radiator from the hot water heater, e. a blower for moving part of the air passing through the said horizontal air duct from the furnace through the said radiator for increasing the temperature of the air passing through the horizontal air duct to the air outlet.

2. A closed building having at least one floor and a space beneath said floor having a hot air heating unit in the form of a furnace and a hot water heating unit associated therewith, wherein the furnace is provided with a burner and an air blower for circulating heated air through the furnace and the interior of said building;

a. an air inlet conduit to the furnace within the building positioned adjacent said floor;

b. a blower associated with said furnace for moving the air through the furnace heating unit from the said air inlet conduit to an air outlet within the interior of said building;

c. the water heater heating unit having means for connecting the same with a water heated radiator positioned within the air outlet leading from the furnace and a second blower positioned within said air outlet to force air over the said radiator;

d. the air inlet leading to the furnace having means adjacent the air inlet connecting the same with the furnace air outlet and a oneway inlet valve admitting air to pass into the air outlet conduit when the blower of the furnace heating unit is not in operation;

e. said outlet conduit having a space surrounding the said radiator allowing air to pass freely about the radiator when the second blower forcing air to circulate through the radiator is not in operation.

* * * * *